US005650017A

United States Patent [19]

Gordon et al.

[11] Patent Number: 5,650,017

[45] Date of Patent: Jul. 22, 1997

[54] WASHING PROCESS AND COMPOSITION

[75] Inventors: James William Gordon, Berkel en Rodenrijs; Alan Digby Tomlinson, Vlaardingen, both of Netherlands

[73] Assignee: Lever Brothers Company, Division of Conopco, Inc., New York, N.Y.

[21] Appl. No.: 496,348

[22] Filed: Jun. 29, 1995

[30] Foreign Application Priority Data

| | | | |
|---|---|---|---|
| Jul. 4, 1994 | [EP] | European Pat. Off. | 94201919 |
| Mar. 30, 1995 | [EP] | European Pat. Off. | 95200808 |

[51] Int. Cl.[6] ..... C11D 1/00

[52] U.S. Cl. ..... 134/7; 134/25.2; 134/42; 510/180; 510/224; 510/227; 510/220

[58] Field of Search ..... 134/7, 25.2, 42; 252/174.25, 174.13

[56] References Cited

U.S. PATENT DOCUMENTS

| | | | |
|---|---|---|---|
| 3,966,627 | 6/1976 | Gray | 252/174.25 |
| 4,405,483 | 9/1983 | Kozel et al. | 252/174.25 |
| 4,405,484 | 9/1983 | Miyazaki et al. | 252/174.25 |
| 4,534,880 | 8/1985 | Kosal et al. | 252/174.13 |
| 4,707,290 | 11/1987 | Seifer et al. | 252/174.13 |
| 4,828,749 | 5/1989 | Krose et al. | 252/135 |
| 4,832,862 | 5/1989 | Joubert et al. | 252/174.13 |
| 4,839,078 | 6/1989 | Kruse et al. | 252/99 |
| 4,844,831 | 7/1989 | Joubert et al. | 252/174.13 |
| 4,861,510 | 8/1989 | Wilms et al. | 252/174.13 |
| 5,041,232 | 8/1991 | Batal et al. | 252/94 |
| 5,047,163 | 9/1991 | Batal et al. | 252/102 |
| 5,066,415 | 11/1991 | Dany et al. | 252/174.25 |
| 5,205,954 | 4/1993 | Ahmed et al. | 252/174.25 |
| 5,232,514 | 8/1993 | Van Sciver et al. | 134/42 |
| 5,240,633 | 8/1993 | Ahmed et al. | 252/99 |
| 5,470,509 | 11/1995 | Pancheri | 252/174.25 |
| 5,480,578 | 1/1996 | Hirsch et al. | 252/174.13 |

FOREIGN PATENT DOCUMENTS

| | | |
|---|---|---|
| 110 472 | 6/1984 | European Pat. Off. . |
| 252 708 | 1/1988 | European Pat. Off. . |
| 314 061 | 5/1989 | European Pat. Off. . |
| 430 818 | 6/1991 | European Pat. Off. . |
| 436 971 | 7/1991 | European Pat. Off. . |
| 446 761 | 9/1991 | European Pat. Off. . |
| 458 397 | 11/1991 | European Pat. Off. . |
| 510 761 | 10/1992 | European Pat. Off. . |
| 518 719 | 12/1992 | European Pat. Off. . |
| 2 205 851 | 12/1988 | United Kingdom . |
| 95/02724 | 1/1995 | WIPO . |

OTHER PUBLICATIONS

The Chemistry of Silica—Solubility, Polymerization, Colloid and Surface Properties, and Biochemistry, Ralph K. Iler (A Wiley–Interscience Publication).

International Search Report.

European Search Report.

M. Alderliesten, Anal. Proc. vol. 21, May 1984, pp. 167–172.

Herdan, E., "Small Particle Statistics", second revised ed., Butterworth, London 1960.

*Primary Examiner*—Jill Warden

*Assistant Examiner*—Sharidan Carrillo

*Attorney, Agent, or Firm*—A. Kate Huffman

[57] ABSTRACT

The invention relates to a process of mechanically washing soiled articles with a wash liquor having a low pH and comprising silica material, to a mechanical dish washing composition producing a low pH and comprising silica, to a method of preparing a mechanical dish washing composition comprising silica, to silica granules as well as their preparation and to the use of silica material.

3 Claims, No Drawings

WASHING PROCESS AND COMPOSITION

TECHNICAL FIELD

This invention relates to a process of mechanically washing soiled articles with a wash liquor, low pH mechanical dish washing compositions, a method of preparing low pH mechanical dish washing compositions and use of compounds to reduce glass corrosion and/or improve decor care and/or to protect glaze and/or iridescence.

BACKGROUND OF THE INVENTION

A problem of automatic dish washing compositions that are currently used in the market is that they may cause poor glass appearance attributed to glass corrosion and may affect the decor of articles, e.g. discolouration, fading and dullness of colours. This is especially true when using high pH compositions and the problem may be particularly noticeable for articles with on-glaze decoration.

GB-A-2,205,851 discloses the use of alkali metal silicate material as an anti-stain agent and indicates that these silicates improve the corrosion protection of the composition.

EP-A-0,446,761 discloses the use of alkali metal silicate material to provide alkalinity and protection of hard surfaces, such as fine china glaze and pattern.

Stannum compounds have also been suggested in the art to overcome glass corrosion, but these compounds may have negative effects on stain removal.

There is a tendency in the automatic dishwashing market towards the use of (relatively) low pH, say lower than 11, cleaning compositions that produce a washing liquor with a lower pH, say lower than 11. Such compositions have e.g. been described in DE 1,302,394 and EP-A-0,414,197.

We have found that, even though less noticeable, glass corrosion and/or decor problems (especially articles with on-glaze decoration) may still occur when wash liquors of lower pH are used. Glass corrosion is glass dissolution and may e.g. lead to weight loss and occurence of iridescence, which are not consumer preferred. Decor care problems are the fading of colours on articles with decoration.

Glass corrosion and decor problems in particular occur in wash liquor that comprises one or more ingredients selected from builder, bleach, enzymes, sequestrants, anti-scaling agents and crystal-growth inhibitors.

The compounds that have been suggested in the art to overcome the above problems are not usually suitable to be included in low pH product and/or have low performance at low pH, especially in liquids. For example, incorporation of sodium silicate in a low pH aqueous product (say with a pH of lower than 11) may severly increase the viscosity, due to polymerisation of the silicate. Further, silicate material has the disadvantage that it increases the product pH and it is a hazardous ingredient that can be aggressive to skin and eyes, especially when in the metasilicate and disilicate forms. Furthermore, we have found that silicate may lead to iridescence of glass, giving it a coloured appearance when held to the light.

We have further found that detergent compositions in the art show tarnishing effects, e.g. on silver articles like cutlery.

It is therefore an object of the present invention to reduce glass corrosion and/or improve decor care and/or protect the glaze of soiled articles and/or reduce iridescence, in particular on glasses and/or plates, after washing with a low pH cleaning composition in automatic dish washing processes. It is a further object of the present invention to reduce tarnishing. It is preferred to overcome all these problems.

Further, we have found that silica inclusion in liquid and/or solid detergent compositions (e.g. powder or tablet) may lead to problems. Silica material is very fine and has a low bulk density in comparison to other typical detergent ingredients. Silica has been found to give setting in liquid products and it has been found to separate out as well as affecting powder flow which also has deleterious consequences for tablets, e.g. on powder flow properties and tablet strength. Further, silica may not be well-delivered to the wash liquor from the mechanical dish washing composition, leading to lower effectiveness in overcoming one or more of the above mentioned problems.

It has now surprisingly been found that the glass corrosion and/or the decor care and/or glaze protection of soiled articles and/or iridescence when washed with a cleaning composition in an automatic dish washing process at a low pH can be substantially improved if the composition comprises silica material. We have further surprisingly found that tarnishing may be reduced by using silica material. It is in particular surprising as silica is known as an inert ingredient.

It has now surprisingly been found that silica inclusion problems and/or silica delivery problems can be substantially improved if the silica material is included in detergent compositions in aggregated and preferably in granulated form.

STATEMENT OF THE INVENTION

Accordingly, the invention provides a process of mechanically washing soiled decorated articles in a mechanical washing machine with a wash liquor having a pH higher than 6.5 and lower than 11 and comprising silica material at a level of at least $2.5\times10^{-4}$% and at most $1\times10^{-1}$% by weight of the wash liquor.

Silica has been found to have beneficial glass corrosion, decor care, glaze protection and/or iridescence effects on glass and decorated articles. Therefore, the soiled articles are preferably glasses and/or decorated plates.

The invention further provides a mechanical dish washing composition having a 1% aqueous solution pH at 25° C. of higher than 6.5 and lower than 11 comprising silica material. Preferably, the silica is in granulated form, more preferably on the inside of the granules.

The invention further provides a method of preparing an aqueous liquid mechanical dish washing composition having a 1% aqueous solution pH at 25° C. of higher than 6.5 and lower than 11, said composition comprising silica material, by dispersing the silica material in the aqueous composition.

The invention further provides a method of preparing a powder or tablet mechanical dish washing composition having a 1% aqueous solution pH at 25° C. of higher than 6.5 and lower than 11, said composition comprising silica material, by granulating the silica material.

The invention further provides a granule comprising silica material and a binding agent, wherein the silica material is present inside the granule and wherein the granules comprises more than 1% by weight and less than 98% of silica material.

The invention further provides a process for granulating silica wherein the silica material is granulated in the presence of a binding agent.

The invention further provides the use of silica material in mechanical dish washing compositions to reduce glass corrosion and/or to improve decor care and/or as glaze protection and/or to reduce iridescence, preferably at low pH.

DESCRIPTION OF THE INVENTION

Silica material

Silica material for use in processes for mechanical dish washing has been described as ingredient for rinse aid compositions, e.g. in EP-A-0,252,708 and DE 28 09 371. Rinse aid compositions usually have a pH of lower than 5.0, e.g. a pH of 4 as described in DE 28 09 371.

The use of silica as film inhibitor in automatic dishwashing compositions has been described in EP-A-0,314,061 and DE-A-38 33 378.

WO 95/02724 discloses the use of silica as coating on percarbonate particles to improve stabilisation. The level of silica is however low and the silica is present on the outside of the particles.

EP-A-0,430,818 discloses detergent compositions comprising silica material in combination with polyacrylic acid polymers. The compositions are powdered compositions comprising silicate material which will provide high wash liquor pH. The silica-polymer combination is described as anti-filming and/or anti-spotting agents to obtain dry sparkling clean dishes, glasses, cups and eating utensils and to overcome spots or films of deposits on the glass, which is completely different from the currently found decor care, glass corrosion, glaze protector and iridescence effects at low pH and low silicate levels.

EP-A-0,110,472 discloses the aqueous liquid detergent compositions comprising silica material, wherein the silica acts as to inhibit the corrosive and discolouring of the washing liquid on metal or enamel- parts of the washing machine and to prevent thereby the malfunctioning of the machines or the discolouring of fabrics which come into contact with such corroded parts. It is clear that this disclosure only relates to fabric washing. This is also illustrated by the high-foaming compositions of the examples of the document. In contrast, compositions of the present invention are used in mechanical dish washing machines in a mechanical dish washing process and they are e.g. low-foaming. Further, the articles that are being used in EP-A-0,110,472 are aluminium plates, where the present invention is directed to decorated plates and glasses. Note that EP-A-0,110,472 only relates to liquids, whereas the present invention also relates other product forms as well.

EP-A-0,518,719 discloses nonaqueous liquid compositions for use in automatic dish washing process comprising at least 40% by weight of non-aqueous carrier materials and up to 4.0% of silica material, as a stabilising agent in the non-aqueous phase. Not only fused silica is used (not preferred according to the present invention), but more importantly the document requires the use of high levels of solvent, i.e. at least 20% and further uses the silica material as stabiliser in such solvent containing phase. The present invention however relates to other (aqueous and powdered) compositions in which silica of the present invention does not serve as a stabiliser.

Silica has been suggested for inclusion in prior art powders as a flowing aid at low levels, e.g. 0.5% by weight. However, the present invention preferably uses higher levels and will further be distinct in being in particular directed to low pH producing composition comprising low or substantially none silicate material.

In view of the many disadvantage of silicate material, e.g. increase of pH, aggresive ingredients and polymerisation in liquids, it is preferred, in particular for liquids, that the compositions according to the present invention are silicate free. For the purpose of this invention, a silicate free composition is defined as a composition that comprises at most 5% by weight, preferably at most 3%, more preferably at most 1%, most preferably at most 0.5%, in particular substantially free of silicate, di-silicate material, metasilicate material, polysilicates or a mixture thereof. It is noted that silicate may however be used e.g. as a binding agent during granulation.

Suitable forms of silica include amorphous silica, such as precipitated silica, pyrogenic silica and silica gels, such as hydrogels, xerogels and aerogels, or the pure crystal forms quartz, tridymite or crystobalite, but the amorphous forms of silica are preferred. Suitable silicas may readily be obtained commercially. They are sold, for instance under the Registered Trade Name Gasil 200 (ex Crosfield, UK).

Preferably, the silica material is present in the wash liquor at a level of at least $2.5\times10^{-4}$%, more preferably at least $12.5\times10^{-4}$%, most preferably at least $2.5\times10^{-3}$% by weight of the wash liquor and preferably at most $1\times10^{-1}$%, more preferably at most $8\times10^{-2}$%, most preferably at most $5\times10^{-2}$% by weight of the wash liquor.

Generally and preferably, the silica material is present in the cleaning composition at a level of at least 0.1%, more preferably at least 0.5%, most preferably at least 1% by weight of the cleaning composition and preferably at most 10%, more preferably at most 8%, most preferably at most 5% by weight of the cleaning composition. However, for liquid compositions, the silica material is preferably present at a level of at least 0.1%, more preferably at least or even more 0.5%, most preferably at least or even more than 1% by weight of the cleaning composition and preferably at most 15%, more preferably at most 12%, most preferably at most 10%, in particular preferred at most 8% and more in particular at most 5% by weight of the cleaning composition. However, for solid compositions, the silica material is preferably present at a level of at least 0.1%, more preferably at least or even more than 0.5%, most preferably at least or even more than 1% by weight of the cleaning composition, in particular preferred at least 2%, more in particular at least 3% and most particular at least 8% and preferably at most 40%, more preferably at most 30%, most preferably at most 20% by weight of the cleaning composition.

In one embodiment, the invention relates to use of lower levels (say up to 5% or preferably 4%) of silica material to overcome decor care problems. In another embodiment, higher silica levels (say up from 6%, preferably 8%) are used to additionally overcome glass corrosion problems.

Preferably, the silica is in the product in such a form that it can dissolve when added to the wash liquor. Addition of silica by way of addition of anti-foam particles of silica and silicone oil is therefore not preferred. Additionally, the silica is preferably present in such a form that it can stably be incorporated in detergent compositions.

The particle size of the silica material of the present invention may be of importance, especially as it may be that any silica material that remains undissolved during the washing process, may deposit on the glass at a later stage.

For the purpose of this invention, three levels of silica particles can be distinguished, the primary, the aggregated and the granulated particles.

Primary particles are the smallest particles, i.e. the single silica particles. Preferably, the primary particle size of the silica is in general less than about 30 nm, in particular less than about 25 nm. Preferably, primary particles size are less than 20 nm or even 10 nm. There is no critical lower limit of the primary particle size; the lower limit is governed by other factors such as the manner of manufacture, etc. In general commercial available silicas have primary particle sizes of 1 nm or more.

Aggregated particles are the silica particles as they are usually commercially available, i.e. several silica particles bound together. The aggregated particle size (as determined with a Malvern Laser, i.e. "aggregated" particles size) is preferably at most 40 μm, more preferably at most 30 μm, most preferably at most 20 μm provides better results in the wash and preferably at least 1 μm, more preferably at least 2 μm, most preferably at least 5 μm.

Granulated particles are granules that comprise silica material that are obtained by granulating silica, e.g. as described hereunder.

Silica granules

In a preferred embodiment of the invention, silica material in granulated form is used. Such granules overcome problems of silica inclusion in detergent products, whilst still enabling good delivery of silica to the wash liquor. Granules may be used in liquids and, preferably, in solid detergent compositions. Use of silica granules in liquids leads to lower viscosity and better pourability.

Preferably, the silica-granules further comprise a binding agent. Preferably, the binding agent is selected from polymers, organic carboxylates, inorganic salts, soaps and mixtures thereof.

Preferably, the polymer binding agent is either in its salt and/or its acid form selected from polycarboxylic acid polymers, polypeptides and polyether polymers (such as PEG). Suitable polycarboxylic acid polymers comprise e.g. a water-soluble homopolymer or copolymer having a molecular weight of at least 500. It may be derived from a monocarboxylic acid or from a di-, tri- or polycarboxylic acid. The polymer will normally be used in the form of its water-soluble alkali metal salt.

One group of polymer materials found to be of value comprises homopolymers derived from a monomer of the formula:

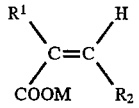

wherein $R^1$ is hydrogen, hydroxyl, $C_1$–$C_4$ alkyl or alkoxy, acetoxy, or —$CH_2COOM$; $R^2$ is hydrogen, $C_1$–$C_4$ alkyl or —COOM and M is an alkali metal. Examples of this group include the sodium and potassium salts of polyacrylic, polymeth-acrylic, polyitaconic, polymaleic and polyhydroxyacrylic acids and also the hydrolysis products of the corresponding polymerised acid anhydrides. Thus the polymer obtained by hydrolysis of maleic anhydride falls within this group.

A second group of suitable polymeric materials comprises the copolymers of two or more carboxylic monomers of the above formula. Examples of this group include the sodium and potassium salts of copolymers of maleic anhydride with acrylic acid, methacrylic acid, crotonic acids, itaconic acid and its anhydride and/or aconitic acid.

A third group of suitable polymeric materials comprises the copolymers of one carboxylic monomer of the above formula and two or more non-carboxylic acid monomers such as ethylene, propylene, styrene, alpha-methylstyrene, acrylonitrile, acrylamide, vinylacetate, methylvinylketone, acrolein and esters of carboxylic acid monomers such as ethyl acrylate and methacrylate.

Suitable polypeptides which can be incorporated in granules according to the present invention include for example polyaspartate and polyglutamate.

Preferably, the organic carboxylate binding agent is selected from di-, tri- or tetracarboxylates, in particular the alkali metal salt of citrate acid, mellitic acid, oxydisuccinic acid, carboxymethoxysuccinic acid, malonic acid, dipicolinic acid or alkenyl succinic acid.

Preferably, the inorganic salts are selected from alkali metal tripolyphosphate, alkali metal carbonate, alkali metal bicarbonate, alkali metal silicate, alkali metal sesquicarbonate and alkali metal sulphate. One of the advantages of incorporating such an inorganic salt is that it increases the solubility of the granule in the wash liquor. Silicates may be used as binding agent, in particular silicate having a SiO2:Na2O ratio between 2 and 3.3, but is less preferred, in particular for liquids. Most of the salts also act as a builder, reinforcing detergent activity. Non-phosphate inorganic salts such as various carbonates, especially alkali metal carbonate, bicarbonate and sesquicarbonate are preferred. In the co-granule the inorganic salts are usually present in the form of their lower stable hydrate(s).

Soaps may also be used as binding agent, either in its acid or in its salt form. Preferably, saturated $C_8$–$C_{20}$ soaps are used.

Generally, the moisture content of the silica granules is 1–25% by weight, preferably 2–20% by weight and more preferably 3–10% by weight. Other optional granule ingredients include alkali meal salts of tripolyphosphate and/or sulphate, organic phosphonates, enzyme stabilisers, anti-scaling agents, corrsion inhibitors, crystal growth inhibitors, threshold agents, thickening agents, anionic surfactant, non-ionic surfactants, perfumes, dyestuffs and preservatives.

Granules of the present invention may have various sizes and contain various silica levels, e.g. depending on the product form. We have, in particular, been able to identify specific preferred silica granules that not only overcome silica inclusion problems, but also delivery problems to the wash liquor. In fact, the preferred silica granules according to the invention provide good product properties whilst they remain active in the wash liquor.

Detergent compositions according to the invention, generally and preferably, comprise granules comprising more than 1% by weight and less than 98%, more preferably more than 2% by weight and less than 95% by weight of silica material. The granules according to the invention, generally and preferably, have a D(3,2) average weight particle size (as described in M. Alderliesten, Anal. Proc. Vol. 21, May, 1984, 167 to 172) of at least 50 μm and at most 1500 μm.

Preferred granules, in particular for use in liquid detergent compositions are silica granules that, in view of optimal product stability and performance, have a D(3,2) average weight particle size (as described in M. Alderliesten, Anal. Proc. Vol. 21, May, 1984, 167 to 172) of at least 50 μm and at most 1000 μm, more preferably at most 500 μm, most preferably at most 100 μm. Further, these granules preferably comprise more than 20%, more preferably more than 50, most preferably more than 80% by weight of silica material and preferably comprise less than 98%, more preferably less than 98% by weight of the granule.

Other preferred granules, in particular for use in solid detergent compositions, have a D(3,2) average weight particle size of from 100 to 1500 μm, more preferably 300 to 1000 μm, most preferably 500 to 700 μm and a Rosen Rammler N-value above 2.5 (as described in detail in "Small Particle Statistics" by Herdan, E; second revised edition; Butterworth, London 1960,, in particluar pp 86–101; graph paper according to DIN 1171 (new) is often used to determine the N-value) and a bulk density as a granule powder from 300 to 1600 kg/m$^3$, preferably from 500 to 1200 kg/m$^3$.

Two types of silica containing granules for solid detergent compositions can be identified. The first type are granules comprising more than 50% by weight and less than 98%, more preferably more than 70% by weight and less than 95% by weight of silica material. These generally consist of silica and a binding agent.

The second type of granules will henceforth also be referred to as co-granules, comprise more than 1% by weight and less than 90%, more preferably more than 2% by weight and less than 25% by weight of silica material. These granules consist of silica and other material, such as binding agents, builders, bleaches, enzymes, polymers, etc. Preferred silica granules of this type comprise the following ingredients:

1–90%, preferably 2–25% by weight of silica;

0–98%, preferably 0–60% by weight of alkali metal salt of carboxylic acids, more preferably di, tri or tetra;

0–98%, preferably 0–60% by weight of alkali metal salt of tripolyphosphate;

0–98%, preferably 0–60% by weight of alkali metal (bi) carbonate or sesquicarbonate;

0–20%, preferably 0–10% by weight of alkali metal silicate;

0–20%, preferably 2–15% by weight of polymer;

0–10%, preferably 0–8% by weight of organic phosphonate;

0–60%, preferably 0–50% by weight of alkali metal sulphate;

0–5%, preferably 0–4% by weight of minor ingredients; and

1–25%, preferably 3–20% by weight of moisture.

Process or Preparing Silica Granules

A further embodiment of the present invention is directed to a process of preparing silica granules by granulating the silica in the presence of a binding agent.

It is known to use silica material as flowing aid for granules. However, the silica will then be present evenly divided over all the granules of the compositions, it will be used at very low levels (e.g. 0.5%) and it will only be present on the outside of the granule particles.

The present invention however is directed to silica granules that comprise high levels of silica material, preferably not primarily outside, but also inside the granule, and, in one embodiment of the invention, i.e. in the co-granule, the silica may not evenly be divided over the product. Another aspect of the invention is that preferably the silica is added before the mixing step, whereas silica as flowing aid is added after mixing of the granule ingredients.

The process usually comprises preparing a slurry of the ingredients of the granule and drying the mixture by means of suitable equipment and optionally milling and/or restructuring the resulting particles.

Suitable drying equipment is e.g. fluid bed dryer, a turbine dryer such as a turbogranulation drier ex Vomm-Turbo Technology, Vomm Impianti E Processi S.r.l., Milan, Italy and spray towers in which the slurry is atomized and dried in a hot air stream.

Milling and/or restructured may for example be done in a granulation process, e.g. using a Ladige recycler, a Ladige plough share mixer, or any other suitable apparatus, such as a twin roll compactor.

The binding agents are preferably used in their aqueous form during the manufacture of said granules.

pH of wash liquor

The invention relates to washing processes in mechanical dish washing machines wherein the wash liquor has a low pH. By "low pH" is meant here that the pH of the wash liquor is preferably higher than about 6.5, more preferably higher than 7, most preferably higher than about 7.5 and preferably the pH is lower than about 11, more preferably lower than about 10.5, more preferably lower than about 10 (e.g. lower than 9.8), in particular lower than 9.5.

It is preferred that a 1% by weight aqueous solution of the detergent compositions according to the invention provides the above pH ranges at 25° C.

Temperature of Washing Process

We have found that the glass corrosion is more noticeable at higher temperatures. Surprisingly however we have found that the beneficial effects of adding silica material to the wash liquor are more pronounced, in terms of reduction of glass corrosion and/or improvement of decor care and/or protection of glaze and/or reduction of iridescence, at higher temperatures.

Therefore, the present invention preferably relates to processes of mechanically washing soiled articles with a wash liquor at a temperature of at least 40° C., more preferably at least 50° C. Without wishing to be bound by any theory, Applicants believe that the increase in temperature will lead to a higher level of dissolved silica material, which in turn leads to reduction on glass corrosion and/or improved decor care and/or glaze protection and/or iridescence.

Composition

Liquids and powders are well-known in the art. Both compositions can be used to achieve a low pH wash liquor.

Mechanical dish washing compositions according to the present invention have a low pH aqueous solution at 25° C. at a concentration of 1.0%, preferably a pH higher than 6.5, more preferably higher than 7.0, most preferably higher than 7.5 and preferably lower than 11, more preferably lower than 10.5, most preferably lower than 10, in particular lower than 9.5.

Preferably, compositions according to the present invention contain one or more ingredients selected from bleach, builder, enzymes, surfactants, sequestrants, anti-scaling agents and crystal-growth inhibitors.

Preferably the detergent composition contains less than 20% of irritant components selected from peroxygen bleach, silicate, carbonate, protease and surfactant.

Liquid compositions

A preferred embodiment of the present invention is direced to liquid composition. Liquid compositions offer several advantages over solid compositions. For example, liquid compositions are thought of being more convenient to the user, being easier to measure, to dispense and to dissolve into a washing liquor. Further, liquid compositions give more confidence to the consumer of being safer and less harsh to the wash than solid compositions.

However, liquid cleaning compositions are often concentrated products and the number of interactions between the ingredients of such products makes it in particular difficult to prepare compositions that are chemically and physically stable upon storage. This is in particular true as compared with powdered products in which components have a more or less fixed position in the product during storage.

Preferably, the liquid compositions according to the invention have a low pH. By "low pH" is meant here that the composition preferably has a pH of higher than 5.0, preferably higher than 5.5, more preferably higher than 6.0, most preferably higher than 6.5, in particular higher than 7.0 and especially preferred is higher than 7.5. Preferably, the pH is lower than 11, more preferably lower than 10.5, more preferably lower than 10, in particular lower than 9.5.

The term "liquid" used herein encompasses low-viscosity liquids to the more highly viscous liquids as well as gels and pastes. However, we have surprisingly found that in view of dispenser leakage as well as pourability, it is preferred that liquid detergents compositions according to the present invention have a viscosity of at least 800 mPa.s, more preferably at least 1,000 mPa.s, most preferably at least 1,350 mPa.s at 20 $s^{-1}$ at 25° C. and preferably at most 3,000 mPa.s, more preferably at most 2,500 mPa.s, most preferably at most 1,850 mPa.s at 20 $s^{-1}$ at 25° C. as measured with a Haake RV 20 Rotovisco. Further it is preferred that the liquid detergents compositions have a viscosity of at least 4,000 mPa.s, more preferably at least 6,000 mPa.s, most preferably at least 9,500 mPa.s at 0.9 $s^{-1}$ at 25° C. and preferably at most 30,000 mPa.s, more preferably at most 25,000 mPa.s, most preferably at most 18,000mPa.s at 0.9 $s^{-1}$ at 25° C.

Preferably, liquid compositions according the present invention are concentrated, not only in view of consumer preferences, but also in view of lower distribution costs and less shelf space occupance. Therefore, liquid composition according to the present invention preferably having water contents of from about at least 20%, more preferably at least 25%, most preferably at least 35% by weight and preferably at most 55% by weight, more preferably at most 50% by weight and most preferably at most 45% by weight.

Solid Compositions

Another embodiment of the present invention is directed to powdered and tablet compositions comprising silica material. Solid compositions are preferred in view of their chemical and physical stability, but may show problems relating to dispersibility, bulk density, dynamic flow properties and table or granule strength.

Silica material is preferably incorporated in solid detergent compositions in granulated form. Inclusion in solid detergent compositions is preferred as such compositions have a high formulation flexibility, allowing incorporation of high levels of silica material.

Preferably, solid compositions according to the invention comprise at least 0.1% by weight of the first type of silica granules (with relatively high silica levels), more preferably at least 0.5%, most preferably at least 1%, in particular at least 1.5%, more in particular at least 2%, and preferably less than 50%, more preferably less than 25% by weight. Preferably, solid compositions according to the invention comprise at least 5% by weight of the second type of silica granules (the co-granule; with relatively low silica levels), more preferably at least 25%, most preferably at least 50% and preferably less than 95%, more preferably less than 90% by weight of the composition.

Solid compositions according to the present invention may be selected from powders and tablets.

Powder Compositions

Powders according to the present invention generally have a bulk density as a granule powder from 300 to 1600 $kg/m^3$, preferably from 500 to 1200 $kg/m^3$.

It is envisaged that the powder is free flowing with a dynamic flow rate of preferably at least 60, more preferably greater than 80 mls/sec.

Preferably, granulation is performed with a liquid/solid ratio of at least 0.1, more preferably at least 0.2 and preferably at most 0.5, more preferably at most 0.4.

Tablet Compositions

Detergent tablets may comprise from about 1 to about 90%, preferably from about 25 to about 85% by weight, more preferably from about 40 to about 85% by weight, of granules according to the invention.

The tablets of the invention preferably have a bulk density of at least about 1300 $kg/m^3$.

The strength of the tablet of the invention should preferably be high enough to allow handling without the need for individual wrapping. The tablet strength is defined as the force, expressed in Newtons, needed to break the tablet, as measured using a Chatilion type UTSM (remote 500) instrument in a direction perpendicular to the direction of compression. The tablet strength should preferably be at least about 150 Newton, more preferably at least about 200 Newton, so as to be sufficient for the tablet concerned to survive handling and packing. On the other hand, the tablet strength should not be too high, since in such a case the dissolution characteristics of the tablet concerned may not be adequate. The tablet strength should generally be below about 1000 Newton, preferably below about 800 Newton, more preferably below about 600 Newton, for round tablets. For rectangular tablets, the tablet strength should generally be below about 2000 Newton, preferably below about 1600 Newton, more preferably below about 1400 Newton.

The tablet of the invention may be effectively produced by a process involving the steps of mixing the co-granule material with the other ingredients of the tablet, and compacting the resulting detergent mixture using a pressure of at least 10 $KN/cm^2$.

Builder material

Soluble detergency builder salts useful herein can be of the poly-valent inorganic and poly-valent organic types, or mixtures thereof. Non-limiting examples include the alkali metal carbonates, borates, phosphates, polyphosphates, tripolyphosphates and bicarbonates.

Examples of suitable organic alkaline detergency builder salts are (1) water-soluble amino polyacetates, e.g. sodium and potassium ethylenediamine tetraacetates, nitrilotriacetates and N-(2-hydroxyethyl) nitrilodiacetates; (2) water-soluble salts of phytic acid, e.g. sodium and potassium phytates; (3) water-soluble polyphosphonates, including sodium, potassium and lithium salts of ethane-1-hydroxy-1,1-diphosphonic acid; sodium, potassium and lithium salts of methylenediphosphonic acid.

Additional organic builder salts useful herein include the polycarboxylate materials described in U.S. Pat. No. 2,264,103. The water-soluble salts of polycarboxylate polymers and copolymers, such as are described in U.S. Pat. No. 3,308,067, are also suitable herein.

Another class of suitable builders is that of the so-called water-insoluble calcium ion-exchange builder materials. Examples thereof include the various types of water-insoluble crystalline or amorphous alumino silicates, of which zeolites are the best-known representatives.

Mixtures of organic and/or inorganic builder salts can be used herein.

Preferred builders for use in the invention are sodium citrate, sodium carbonate, and sodium bicarbonate and mixtures thereof, or the potassium salts thereof. The potassium salts may be preferred for solubility reasons. Preferably, the amount of builders in the composition is from about 5 to 60% by weight, more preferably from 25 to about 40% by weight. These range in particular apply to liquid compositions. For solid compositions, the builder level is preferably between 5 and 95%, more preferably between 10 and 90%, most preferably between 20 and 80% by weight of the composition.

Enzymes

Well-known and preferred examples of these enzymes are lipases, amylases and proteases. The enzymes most commonly used in machine dishwashing compositions are amylolytic enzymes. Preferably, the composition of the invention also contains a proteolytic enzyme. Enzymes may be present in a weight percentage amount of from 0.2 to 5% by weight. For amylolytic enzymes, the final composition will have amylolytic activity of from $10^2$ to $10^6$ Maltose units/kg. For proteolytic enzymes the final composition will have proteolytic enzyme activity of from $10^6$ to $10^9$ Glycine Units/kg.

Bleach Material

Bleach material may optionally and preferably be incorporated in composition for use in processes according to the present invention. The bleach material may be a chlorine- or bromine-releasing agent or a peroxygen compound. These materials may be incorporated in solid form or in the form of encapsulates and, less preferably, in dissolved form.

Encapsulation techniques are known for both peroxygen and chlorine bleaches, e.g. as described in U.S. Pat. Nos. 4,126,573, 4,327,151, 3,983,254, 4,279,764, 3,036,013 and EP-A-0,436,971 and EP-A-0,510,761. The coatings can be applied in a variety of well-known methods including tumbling the coated compound in a rolling mill, spraying a solution or suspension of the coating into a fluidized bed of the compound to be coated, precipitating the coating from a solvent on to the compound to be coated which is in suspension in the solvent, etc.

A preferred encapsulated bleach particle for use in the present invention is that as described in the above-mentioned European patent applications, comprising 35–55% by weight of the particle of a single coat of paraffin wax and 45–65% by weight of a core of a chlorine or peroxygen bleach compound.

Particulate, water-soluble anhydrous inorganic salts are likewise suitable for use herein such as hypochlorite, hypobromite, chlorinated trisodium phosphate, chloroisocyanurates and dichloroisocyanurate.

Organic peroxy acids or the precursors therefor may also be utilized as bleach material. In general, peroxyacids containing at least about 7 carbon atoms are sufficiently insoluble in water for use herein.

Mono- and di-peroxy acids are also useful in compositions according to the invention.

Peroxyacid bleach precursors are well known in the art. As non-limiting examples can be named N,N,N',N'-tetraacetyl ethylene diamine (TAED), sodium nonanoyloxybenzene sulphonate (SNOBS), sodium benzoyloxybenzene sulphonate (SBOBS) and the cationic peroxyacid precursor (SPCC) as described in U.S. Pat. No. 4,751,015.

Inorganic peroxygen-generating compounds may also be suitable as cores for the particles of the present invention. Examples of these materials are salts of monopersulphate, perborate monohydrate, perborate tetrahydrate, and percarbonate.

If desirably a bleach catalyst, such as the manganese complex, e.g. Mn-Me TACN, as described in EP-A-0458,397, or the sulphonimines of U.S. Pat. Nos. 5,041,232 and 5,047,163, is to be incorporated, this can e.g. be presented in the form of a second encapsulate separately from bleach capsules.

Chlorine bleaches, the compositions of the invention may comprise from about 0.5% to about 3% avC1 (available Chlorine). For peroxygen bleaching agents a suitable range are also from 0.5% to 3% avO (available Oxygen). Preferably, the amount of bleach material in the wash liquor is at least $12.5\times10^{-4}$% and at most 0.03% avO by weight of the liquor.

Surfactant material

A small amount of low to non foaming nonionic surfactant, which includes any alkoxylated nonionic surface-active agent wherein the alkoxy moiety is selected from the group consisting of ethylene oxide, propylene oxide and mixtures thereof, is preferably used. Normally, amounts of 15% by weight or lower, preferably 10% by weight or lower, more preferably 7% by weight or lower, most preferably 5% by weight or lower and preferably 0.1% by weight or higher, more preferably 0.5% by weight or higher are used.

Examples of suitable nonionic surfactants for use in the invention are the low- to non-foaming ethoxylated straight-chain alcohols of the Plurafac® RA series, supplied by the Eurane Company; of the Lutensol® LF series, supplied by the Basf Company and of the Triton® DF series, supplied by the Rohm & Haas Company.

Structurant material

Another optional but highly desirable additive ingredient with multi-functional characteristics, particularly in liquid compositions, is a structurant material, e.g. selected from polymeric material and clay material.

Structuring material provides an external three-dimensional structure to the composition (e.g. liquids) which for example enable incorporation of suspended solid particles. A further advantage of the use of an external structurant in liquid compositions according to the invention is that it allows the preparation of thixotropic liquids with viscosities as indicated above.

Polymeric material having a molecular weight of from 1,000 to 2,000,000 are preferred structurant material. They may e.g. be homo- or co-polymers of acrylic acid. An example of a suitable polymer material is Carbopol, ex BF Goodrich.

Preferably, structurant material is present at a level of at least 0.1%, and preferably at most 3.5% by weight of the composition. Preferably, clay material, if any, is present at a level of at least 1%, more preferably at least 1.5%, and preferably at a level of at most 3.5%, more preferably at most 3%. Preferably polymer material, if any, is present at a level of at least 0.1%, more preferably at least 0.5% and preferably at most 2%, more preferably at most 1.5%.

Optional Ingredients

Optional ingredients are, for example, buffering agents, reducing agents, e.g. alkali metal carbonates, bicarbonates, borates and alkali metal hydroxide; the well-known enzyme stabilizers such as the polyalcohols, e.g. glycerol and borax; anti-scaling agents; crystal-growth inhibitors, threshold agents; thickening agents; perfumes and dyestuffs and the like.

Reducing agents may e.g. be used to prevent the appearance of an enzyme-deactivating concentration of oxidant bleach compound. Suitable agents include reducing sulphuroxy-acids and salts thereof. Most preferred for reasons of availability, low cost, and high performance are the alkali metal and ammonium salts of sulphuroxy acids including ammonium sulphite ($(NH_4)_2SO_3$), sodium sulphite ($Na_2SO_3$), sodium bisulphite ($NaHSO_3$), sodium metabisulphite ($Na_2S_2O_3$), potassium metabisulphite ($K_2S_2O_5$), lithium hydrosulphite ($Li_2S_2O_4$), etc., sodium sulphite being particularly preferred. Another useful reducing agent, though not particularly preferred for reasons of cost, is ascorbic acid.

The amount of reducing agents to be used may vary from case to case depending on the type and quality of the encapsulated bleach particles, but normally a range of about 0.01% to about 1.0% by weight, preferably from about 0.02% to about 0.5% by weight, will be sufficient.

The compositions of the present invention may also comprise, and preferably do, thickening agents, for example a polymer such as a suitable acrylate, methacrylate (or co-polymer thereof) or a cellulose such as hydroxymethyl cellulose. Typical inclusion levels of thickener are from 0.1% to 10%, e.g. from 0.5% to 5% by weight of the total composition.

Use

Compositions according to the present invention may e.g. be dosed in the wash liquor at levels of from 10 g/l to 1.5 and preferably 2.5 g/l.

The invention may be more fully understood by way of the following illustrating Examples.

EXAMPLE 1

The following composition was prepared by adding the ingredients in the order listed (Carbopol is dispersed in acid form):

| | |
|---|---|
| Demineralised water | 48.08 |
| KTP | 34.40 |
| Carbopol 627 1) | 0.80 |
| Borax | 3.00 |
| Glycerol | 6.00 |
| Sodium sulfite | 0.10 |
| Plurafac LF403 2) | 2.00 |
| TiO2 | 0.10 |
| Perfum NSX 2000 | 0.12 |
| Gasil 200TP 3) | 3.00 |
| Bleach (as avCl) | 1.20 |
| Savinase 16 L | 0.60 |
| Termamyl 300 L | 0.60 |

1) Acrylic acid homopolymer, ex BF Goodrich chemical Europe
2) Nonionic, ex BASF
3) Silica material with an average aggregated particle size d50 (by Malvern Laser) of 7–11 μm, ex Crosfield.

Liquid

The composition has a pH of 8.0. A 0.6% solution (0.018% by weight of silica) of the composition in water has a pH of 9.2. The viscosity of the product is 1,400 mPa.s at 20 $s^{-1}$ at 25° C. and 14,000 mPa.s. at 0.9 $s^{-1}$ at 25° C., as measured on a Haake viscometer.

Experiment

The above composition as well as the same composition without the Gasil (silica) were used in a soak washing programme under the following conditions:

Water-bath : MGW Lauda M 6 litres
Temperature : 70° C.
Soaking time : 48 hours
Concentration: 6 grams/liter
Waterhardness: 2 parts Demin and 1 part 14° FH water
Articles : 2 Gilde and Michelangelo wine glass pieces and 2 Mosa plates.

The articles were soaked in product-solutions in the water-bath. After soaking the articles were rinsed with demin water and carefully dried with a Kleenex Tissue. The weight loss of the glass type was determined and the Mosa pieces were scored using the following standard scoring system:

0 : no damage; 1 : colour less shine; 2–4 : dull, little discolouration; 5–7 : dull, clear disclolouration; 8–10 : dull, severe discolouration.

The test with the Mosa pieces was also done with a conventional, high pH powdered composition.

| Results | Composition without Gasil | Composition with Gasil | Conventional high pH powder composition |
|---|---|---|---|
| Scores Mosa pieces | 2–4 | 0 | 10 |
| Weight loss glasses | 0.21% | 0.13% | 0.35% |

As is illustrated above, the glass corrosion (in terms of weight loss), the decor care and the glaze protection of soiled articles was better for the silica containing composition of low pH.

By adding 5% of Gasil to a product similar to the above formulation, 0% weight losses on all article pieces were obtained.

EXAMPLE 2

The following composition was prepared by adding the components in the order listed:

| | |
|---|---|
| Demineralised water | 47.48 |
| Sodium citrate | 30.00 |
| Sokalan CP7 1) | 5.00 |
| Polymer compound | 0.80 |
| Borax | 3.00 |
| Glycerol | 6.00 |
| Sodium sulfite | 0.10 |
| Plurafac LF403 2) | 2.00 |
| TiO2 | 0.10 |
| Perfum NSX 2000 | 0.12 |
| Gasil 200TP 3) | 3.00 |
| Bleach (as avCl) | 1.20 |
| Savinase 16 L | 0.60 |
| Termamyl 300 L | 0.60 |

1) maleic and acrylic acid copolymer MWT 50,000, ex BASF
2) Nonionic surfactant, ex BASF
3) Silica material with an average particle size d50 (by Malvern Laser) of 7–11 μm, ex Crosfield Carbopol 941, Sigma Polygel DK, Sigma Polygel DA and Carbopol 627 were used as polymer thickener compound. Stable products resulted within the viscosity range of 1500 to 1700 mPa.s at 20 s–1 at 25° C. and within 13,000 to 17,000 mPa.s at 0.9 s–1 at 25° C. The 1% solution pH of the liquids were about 8.3 and the pH of the wash liquors about 8.8. Similar results were obtained for these compositions as for the composition of Example 1 with respect to glass corrosion, decor care and glaze protection.

EXAMPLE 3

The composition of Example 1 with and without Gasil were tested in a robotised Miele G595SC. Regeneration salt was used (the waterhardness was 1°–2° FH).

The compositions were dosed at a level of 35 g/wash; the main wash time was 20 minutes; the drying time with open door was 10–20 minutes; the washing temperature was up to 65° C.

The concentration of the silica in the wash liquor was 0.017% (170 ppm). The pH of the wash liquor was 8.8.

100 washes were carried out by loading the machine with on-glaze decorated porcelain, glass, plates plus cutlery, stainless steel articles and plastics as ballast, which prior to the test were washed once in an industrial dish washer.

Glass corrosion, the decor-care and glaze protection of the composition with Gasil was better than the same composition without Gasil.

EXAMPLE 4

The level of Gasil 200TP and Silicate 2.8 were varied in the following base powder:

| Ingredients | weight % |
|---|---|
| Na-citrate | 40.0 |
| Polymer | 6.0 |
| Na-bicarbonate | to 100.0 |
| Perborate monohydrate | 14.0 |
| Granules* | 2.4 |
| Enzymes | 3.3 |
| Nonionic surfactant | 1.5 |

*Granule comprises carbonate, polymer, catalyst as described in EP 458,397 and moisture.

A soak test was carried out that lasted 48 hours at 70° C. at a concentration of 4g/l of the above product. The following results were obtained:

| Product | Weight loss 1) | Iridescence score 2) | Decor care 3) | pH |
|---|---|---|---|---|
| 0% Silicate 2.8 | 0.01 | 1 | 7 | 9.7 |
| 5% | 0.02 | 1 | 0 | 9.7 |
| 10% | 0.02 | 3 | 0 | 9.7 |
| 15% | 0.02 | 3 | 0 | 9.7 |
| 20% | 0.025 | 3.5 | 0 | 9.9 |
| Silica# | | | | |
| 2% | 0.01 | 1 | 1.25 | 9.6 |
| 4% | 0.02 | 3.5 | 0 | 9.5 |
| 5% | 0.02 | 2 | 0 | 9.5 |
| 6% | 0.01 | 2.5 | 0 | 9.4 |
| 8% | 0.02 | 2 | 0 | 9.4 |
| 10% | 0.005 | 1 | 0 | 9.3 |
| 12% | 0 | 1 | 0 | 9.5 |
| 15% | 0 | 1 | 0 | 9.3 |
| 20% | 0.005 | 1 | 0 | 9.5 |

#Gasil, ex Crosfield, a level of 2% silica corresponds at a dosis of 4 g/l with a level of 0.008% by weight in the wash liquor.
1) in weight %; average of 2 measurements on Michelangelo/Gilde
2) average of 2 measurements; the scores are 1-none; 2-little; 3-moderate; 4-heavy; 5-very heavy
3) average of 2 measurements on Mosa plate green/yellow It can be concluded that higher silicate levels lead to more glass corrosion, also in the form of iridescence. Gasil 200 TP dosed at 4 g/l products with 8% or more silica (0.032% by weight silica in the wash liquor), completely prevents glass dissolution and also glass corrosion.

EXAMPLE 5

A formulation was prepared utilising co-granules containing Gasil silica.

| | Example 1 |
|---|---|
| Silica granule | 77.7 |
| Perborate mono | 15.0 |
| Granules* | 2.4 |
| Enzyme | 2.3 |
| Nonionic | 1.5 |
| Perfume | 0.10 |

*Co-granule of carbonate, polymer, catalyst and moisture as described in Example 4.

The silica co-granules contained the following ingredients:

| | parts | % |
|---|---|---|
| Na-citrate 2 aq. | 30.0 | 38.6 |
| Sokalan CP5/PA25 | 6.0 | 7.7 |
| Gasil 200 TP | 13.0 | 16.7 |
| Na-bicarbonate | 28.7 | 36.9 |

Fine citrate, Gasil 200 TP and bicarbonate were granulated with a neutral polymer solution; a liquid/solid ratio of 0.21 was employed. Three batches of 2 kg were granulated in an Eirich mixer at a temperature of 80° C. After granulation, batches of 1 kg were dried in a fluid bed for 15 minutes using hot air (90° C.). Coarse material (>2 mm) was removed). The co-granules had the following characteristics:

| | |
|---|---|
| Rosin Rammler average particle size (microns) | 630 |
| Roslin Rammler N value | 2.2 |
| % < 180 microns | 2.5 |
| % > 1000 microns | 16.4 |
| Bulk density (kg/m$^3$) | 810 |
| Dissolution time at 20° C. (minutes) | <1 |

The above product was made compared with a product without silica co-granules that comprises fine citrate granules and dynamic flow properties measured (mls/sec). The results were:

| | DFR |
|---|---|
| with co-granule | 128 |
| without co-granule | <25 (no flow) |

The powder with the granules had excellent flow properties and showed good decor care and no iridescence. 1% solution had a pH of between 7.5 and 10.

In order to get an idea on the feasibility of producing tablets on an industrial scale, tablets were produced using an Carver hand press at 2 tonnes pressure. The strength of the tablets that were produced with and without the granules was measured using a Chatilion type UTSM (remote 500) instrument. Measurements was carried out in the direction perpendicular to the direction of compression.

The following tablet strength values, expressed in Newtons, were found:

| | Tablet strength |
|---|---|
| with co-granules | 82 |
| without co-granules | 12 |

It can be concluded that the tablets made using granules have a higher tablet strength and a high likelyhood of success when scaled up.

EXAMPLE 6

A wash test of 150 washes was carried out with a loaded Philips Whirlpool D 2X, at 65° C., short programme, without prerinse (position 3), with 2° FH water, using rinse aid, the system being soiled with 40 g soiled wash. Silver spoons and Mosa plates were washed with three products. Anti-tarnishing of the spoons articles was determined using the following standard anti-tarnishing test:

Degree of discolouration of silver articles was measured using an Ultrascan spectrophotometer. From the L, A and B readins in the various colours of the spectra, a resulting factor (Delta E) is calculated according to CIELAB recommendations (JSDC, September 1976 pp 337–8). The higher the results, the more severe the tarnishing. The following results were obtained.

| PRODUCT | Delta E value |
|---|---|
| Conventional powder | 18 |
| Composition of Example 1 without silica | 23 |
| Composition of Example 1 with 2% silica | 8 |

Use of silica in mechanical dish wash compositions leads to hardly any tarnishing, whereas the same composition without silica or conventional powder leads to some visible tarnishing of silver spoons.

The Mosa plates were judged on a scale from 0–10 (higher=better) and the following results were obtained.

| MOSA COLOUR | | PRODUCT | |
|---|---|---|---|
| | Conv. powder | Comp of Ex 1 without silica | Comp. of Ex 1 with 2% silica |
| RED | 0.3 | 7 | 9 |
| GREEN | 2 | 4 | 7.8 |
| ORANGE | 0 | 6.8 | 8 |
| LIGHT GREEN | 0 | 4.5 | 8.3 |
| YELLOW | 0 | 4 | 8.3 |
| PEA GREEN | 6 | 6.3 | 8.3 |
| PINK | 7.3 | 7.8 | 8.5 |
| BLUE | 8 | 7.3 | 8.8 |
| GOLD | 6.8 | 9 | 9 |

Use of silica in mechanical dish wash compositions leads to hardly or no decor fading, whereas the same composition without silica or conventional powder leads to problems. Silica is therefore very suitable as glaze protector.

We claim:

1. A method of washing soiled decorated articles in a mechanical washing machine comprising the steps of:

a) placing soiled decorated articles in a mechanical washing machine;

b) applying an aqueous solution of a composition to said soiled decorated articles, said aqueous solution having a pH higher than 6.5 and lower than 11 at 25° C. and said composition comprising a silica material having a concentration of at least $2.5\times10^{-4}$% and at most $1\times10^{-1}$% by weight of the aqueous solution; and c) washing said soiled decorated articles in said mechanical washing machine.

2. A method according to claim 1, wherein the silica material is present as a granular form inside a granulated material.

3. A method according to claim 1, wherein the silica material is in the form of a powder or a tablet.

* * * * *